US005643005A

United States Patent [19]

Weidler et al.

[11] Patent Number: 5,643,005

[45] Date of Patent: Jul. 1, 1997

[54] CONNECTOR FOR AN ELECTRICAL CABLE

[75] Inventors: Charles Harry Weidler, Lancaster; Hurley Chester Moll, Jr.; David Alan Griesemer, both of Harrisburg; Robert Neil Whiteman, Jr., Middletown; Michael David Long, Harrisburg, all of Pa.

[73] Assignee: The Whitaker Corporation, Wilmington, Del.

[21] Appl. No.: 524,175

[22] Filed: Aug. 21, 1995

Related U.S. Application Data

[63] Continuation of Ser. No. 290,325, Aug. 12, 1994, abandoned.

[51] Int. Cl.[6] ..... H01R 4/24

[52] U.S. Cl. ..... 439/405; 439/904

[58] Field of Search ..... 439/395, 417, 439/400–405, 924.1, 904

[56] References Cited

U.S. PATENT DOCUMENTS

| | | | |
|---|---|---|---|
| Re. 32,439 | 6/1987 | Narozny | 439/404 |
| 4,035,050 | 7/1977 | Volinskie | 339/99 R |
| 4,040,705 | 8/1977 | Huber | 339/99 R |
| 4,083,615 | 4/1978 | Volinskie | 339/17 F |
| 4,175,818 | 11/1979 | Kourimsky et al. | 439/395 |
| 4,442,594 | 4/1984 | Narozny | 29/884 |
| 4,496,206 | 1/1985 | Markwardt et al. | 439/404 |
| 4,676,576 | 6/1987 | Feldberg et al. | 439/404 |
| 4,781,615 | 11/1988 | Davis et al. | 439/395 |
| 4,824,394 | 4/1989 | Roath et al. | 439/395 |
| 4,830,625 | 5/1989 | Vignoli | 439/404 |
| 4,867,690 | 9/1989 | Thumma | 439/79 |
| 4,995,828 | 2/1991 | Goodman et al. | 439/405 |
| 5,104,326 | 4/1992 | Smith et al. | 439/95 |
| 5,118,310 | 6/1992 | Stroede et al. | 439/676 |
| 5,120,235 | 6/1992 | Kashiwa | 439/405 |
| 5,123,859 | 6/1992 | Davis et al. | 439/405 |
| 5,129,840 | 7/1992 | Kuzuno et al. | 439/597 |
| 5,326,286 | 7/1994 | Bixler et al. | 439/751 |
| 5,376,018 | 12/1994 | Davis et al. | 439/405 |

FOREIGN PATENT DOCUMENTS

| | | | |
|---|---|---|---|
| 0 203 793 | 12/1986 | European Pat. Off. . | |
| 0 456 340 A2 | 11/1991 | European Pat. Off. . | |
| 2 361 759 | 3/1978 | France . | |
| 27 38 869 | 3/1979 | Germany | 439/405 |

OTHER PUBLICATIONS

International Search Report.

*Primary Examiner*—Neil Abrams
*Assistant Examiner*—Brian J. Biggi
*Attorney, Agent, or Firm*—Anton P. Ness

[57] ABSTRACT

An electrical connector (1) comprises electrical contacts (3) arranged in two contact rows on opposite sides of an insulator (6), with the contacts (3) in each row being spaced apart laterally one from one another, the contacts (3) being arranged in pairs with the insulator (6) being between the contacts (3) of each pair, mating contact portions (24) on each pair of the contacts (3) overlying each other in opposed spaced relationship, and electrical terminals (26) on each pair of the contacts (3) being offset from each other in lateral directions, and being offset from each other front to rear.

17 Claims, 6 Drawing Sheets

9
35
36
35
36
35
35
36
10
16
18
8
21
2
19
3
3
15
13
20
11
24
12
20
31
5
29
1

CONNECTOR FOR AN ELECTRICAL CABLE

This application is a continuation of application Ser. No. 08/290,325 filed Aug. 12, 1994, now abandoned.

FIELD OF THE INVENTION

The invention relates to an electrical connector for connection to an electrical cable, and, more particularly, to an electrical connector with electrical terminals for connection to conductors of an electrical cable.

BACKGROUND OF THE INVENTION

An electrical connector is known from U.S. Pat. No. 5,129,840 and comprises, two rows of electrical contacts on opposite sides of an insulator. The contacts are close together, and pass by one another on crossing paths. The contacts are thinner where they pass by one another to avoid intersecting engagement with one another.

Another known connector comprises, three identical rows of electrical contacts with offset electrical terminals, with each row being moved over or being inverted to move the contacts of one row to staggered positions relative to the contacts in the other rows.

SUMMARY OF THE INVENTION

According to the invention, an electrical connector comprises two rows of electrical contacts with different shapes on opposite sides of an insulator adapted for assembly as a unit into an insulating housing, the contacts being arranged in pairs, with the contacts of each pair opposing each other across the insulator.

An advantage of the invention resides in a unit adapted for assembly in an insulating housing, comprising, an insulator and multiple contacts having different shapes, which avoids a need for a housing manufactured with passages of different shapes to receive contacts having different shapes.

According to an embodiment of the invention, electrical terminals on respective pairs of electrical contacts are offset from each other in a lateral direction and are offset from each other in a direction front to rear. An advantage resides in terminals that are close together to be connected to conductors of a cable that are side by side and close together.

According to another embodiment of the invention, the terminals on some of the contacts cross over the insulator and are together with the terminals on the remaining contacts to connect with conductors of an electrical cable that are side by side and close together. An advantage resides in a unit constructed with an insulator and contacts on both sides of the insulator, and terminals on the contacts that cross over the insulator to be grouped together to connect with conductors of a cable.

DETAILED DESCRIPTION

Figure 1:
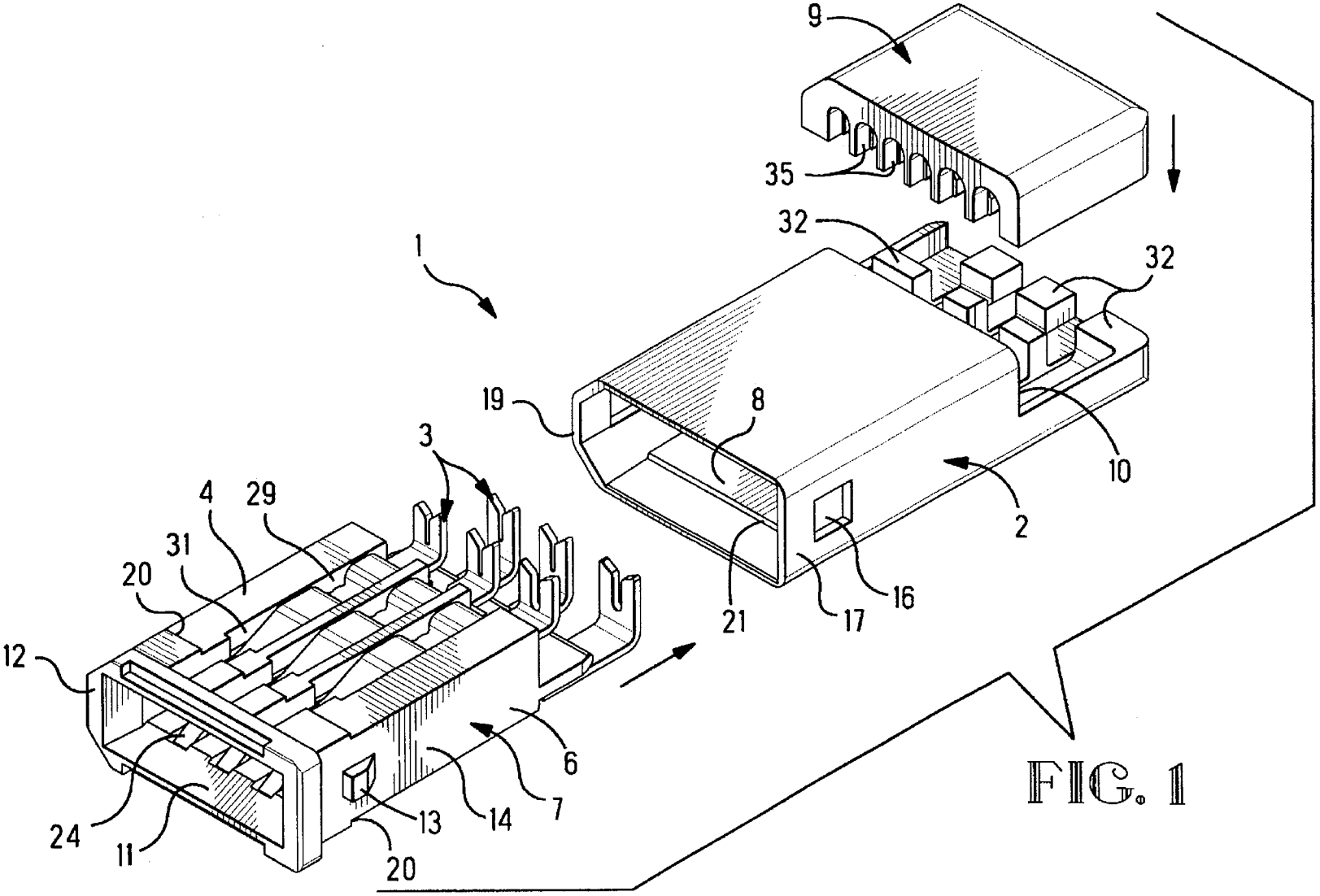
FIG. 1 is an isometric view of an electrical connector with component parts separated to depict details of construction.
Figure 2:
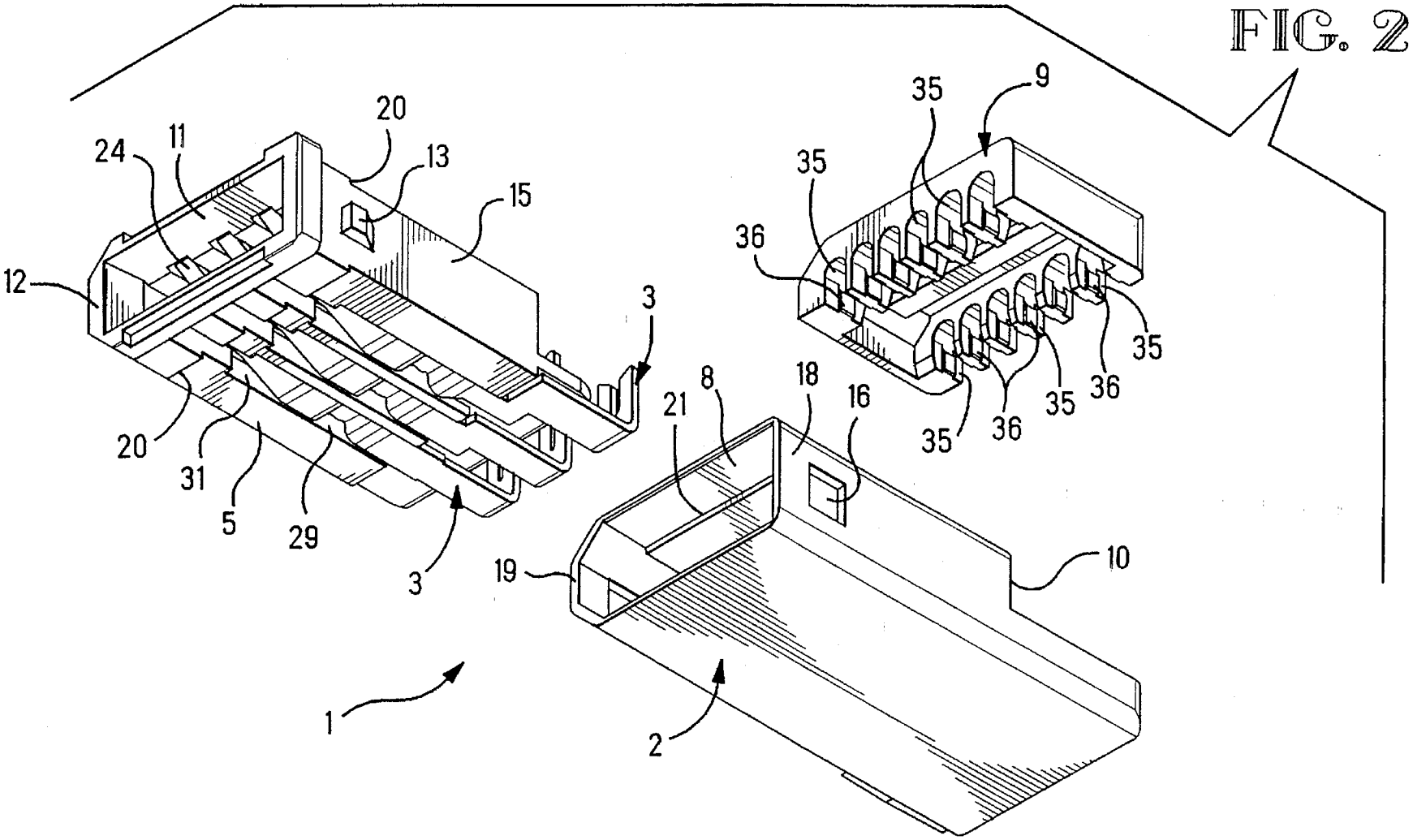
FIG. 2 is an isometric view of the structure shown in FIG. 1, with the structure inverted.

With reference to FIGS. 1 and 2, an electrical connector 1 comprises an insulating housing 2, and multiple electrical contacts 3 arranged in two rows that are on opposite sides 4, 5 of an insulator 6 adapted to be assembled as a unit 7 into a unit receiving cavity 8 in the housing 2, and an insulating cover 9 adapted to cover an open side 10 of the housing 2. The cavity 8 communicates with the open side 10. The contacts 3 in each row are of different shapes, and are offset laterally one from another. A mating connector receiving, deep mouth 11 on a front mating end of the insulator 6 is for mating connection with another mating connector, not shown.

Figure 3:
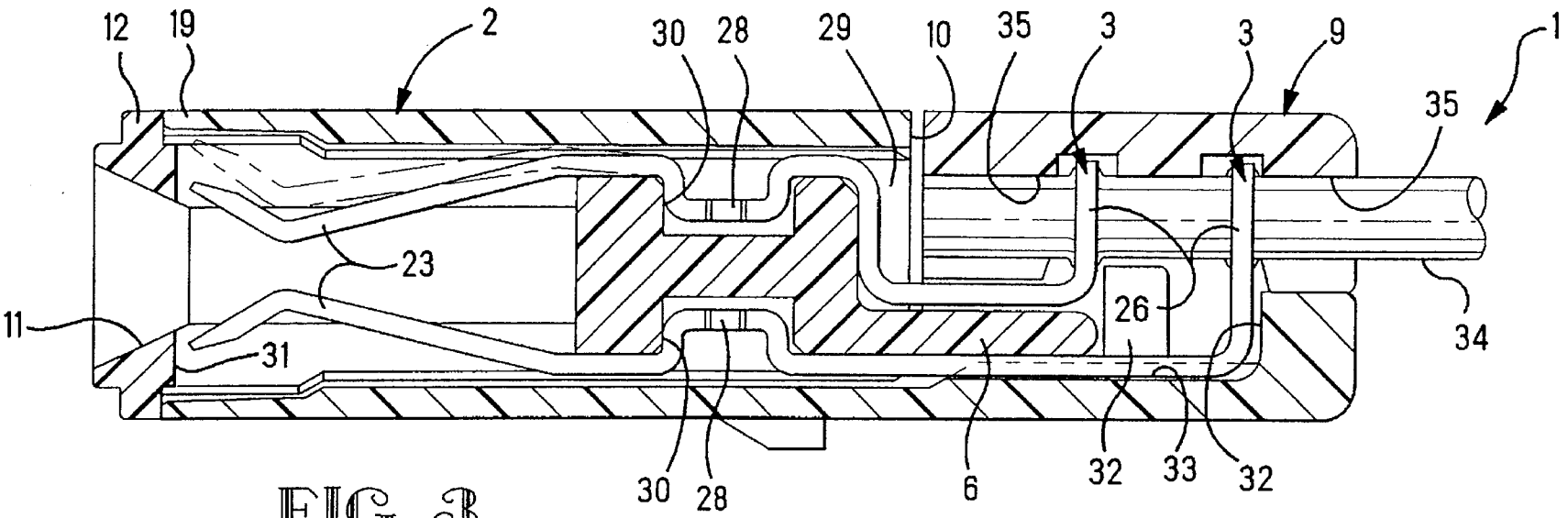
FIG. 3 is a section view of the electrical connector shown in FIG. 1, with the component parts assembled together and connected to an electrical cable.
Figure 6:
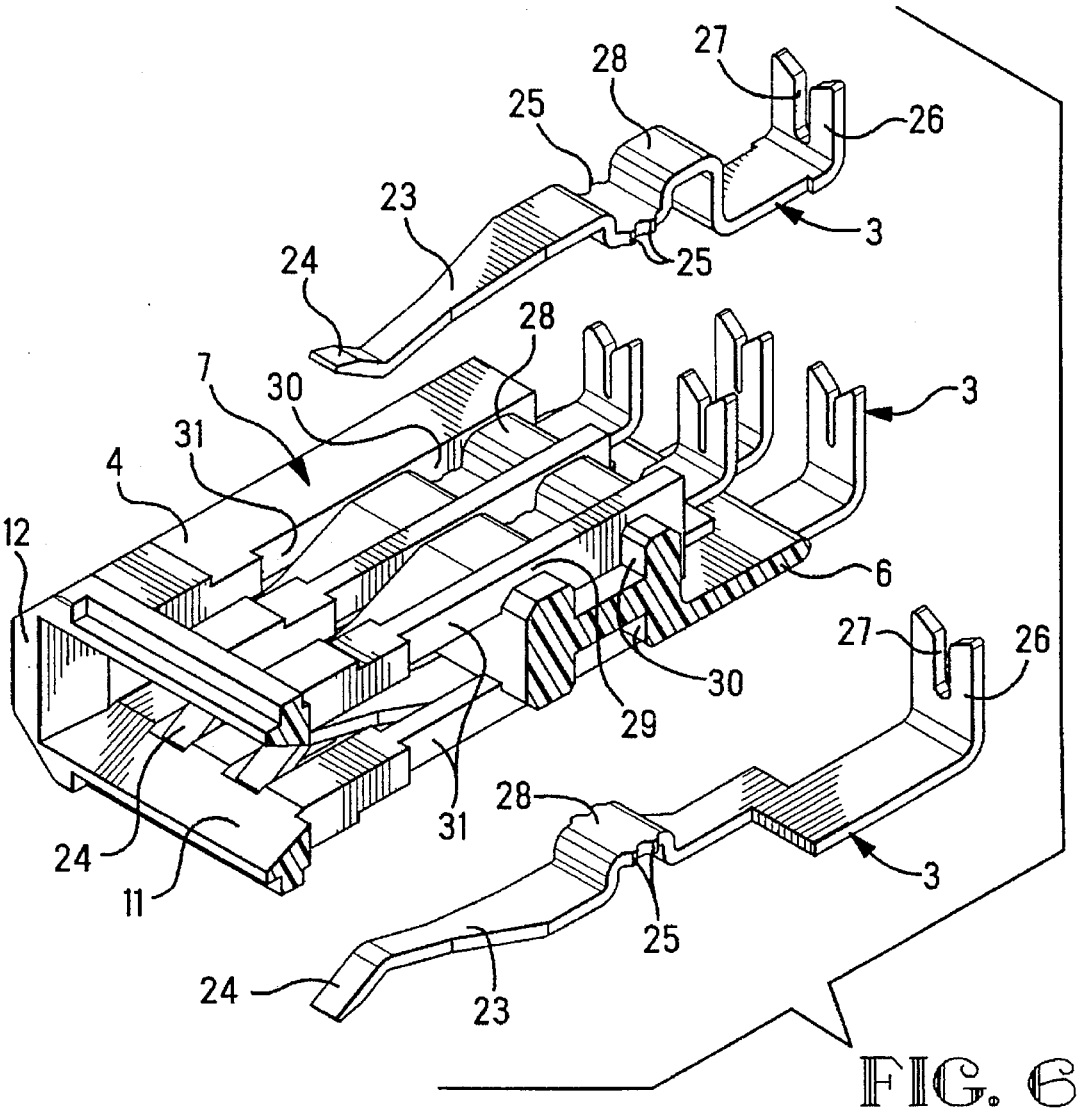
FIG. 6 is an isometric view of an insulator and electrical contacts of the electrical connector shown in FIG. 1, with parts cut away and with parts separated to illustrate details of construction.

A bezel 12 with a nonsymmetrical circumference encircles the mouth 11. The bezel 12 projects outwardly from a front exterior circumference on the deep mouth 11. Both the bezel 12 and the unit receiving cavity 8 of the housing 2 have a nonsymmetrical circumference to provide polarization for mating with a nonsymmetrical mating connector, not shown. A portion of the mating connector fits along the nonsymmetrical circumference. Another portion of the mating connector fits inside the deep mouth 11. With reference to FIG. 6, the unit 7 comprises, the contacts 3 on the insulator 6, adapted to be assembled with the housing 2. With reference to FIGS. 1, 2 and 3, the unit 7 is adapted to be inserted through the mouth 11 to register in the cavity 8. Rear tapering latches 13 on exterior sides 14, 15 on the insulator 6 and rearward of the bezel 12 wedge along the interior of the mouth 11 until they project into latch receiving openings 16 through sides 17, 18 of the housing 2. The projecting bezel 12 impinges against a front 19 of the housing 2 to resist movement of the unit 7 relative to the housing 2. Each of the sides 4, 5 on the insulator 6 is provided with an exterior, rear facing step 20 that is received against an interior, front facing step 21 on respective interior sides on the housing 2 to resist movement of the unit 7 relative to the housing 2. The unit 7 locks with the housing 2. The latches 13 lock in the openings 16 and prevent withdrawal of the insulator 6 in a forward direction relative to the housing 2. The bezel 12 prevents further movement of the insulator 6 in a rearward direction relative to the housing 2.

Figure 7:
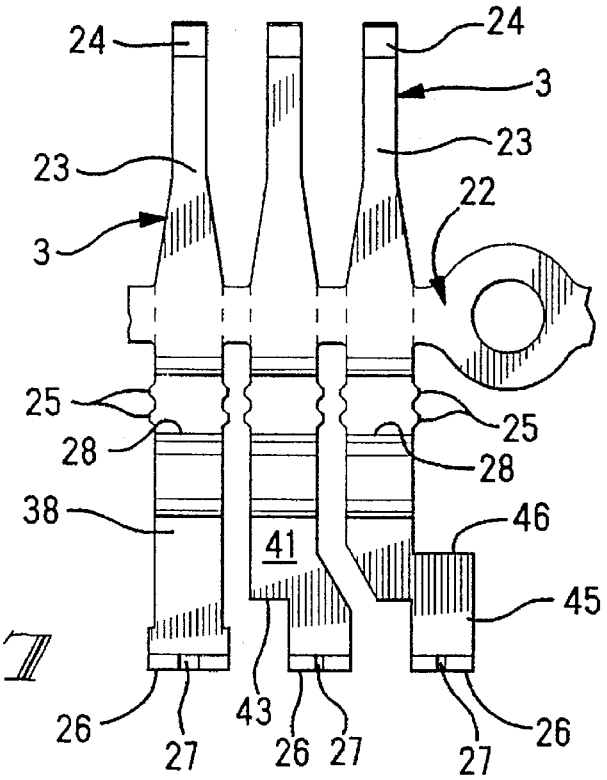
FIG. 7 is a plan view of a first row of electrical contacts in blank form and prior to being formed to shape for use in the electrical connector shown in FIG. 1.
Figure 8:
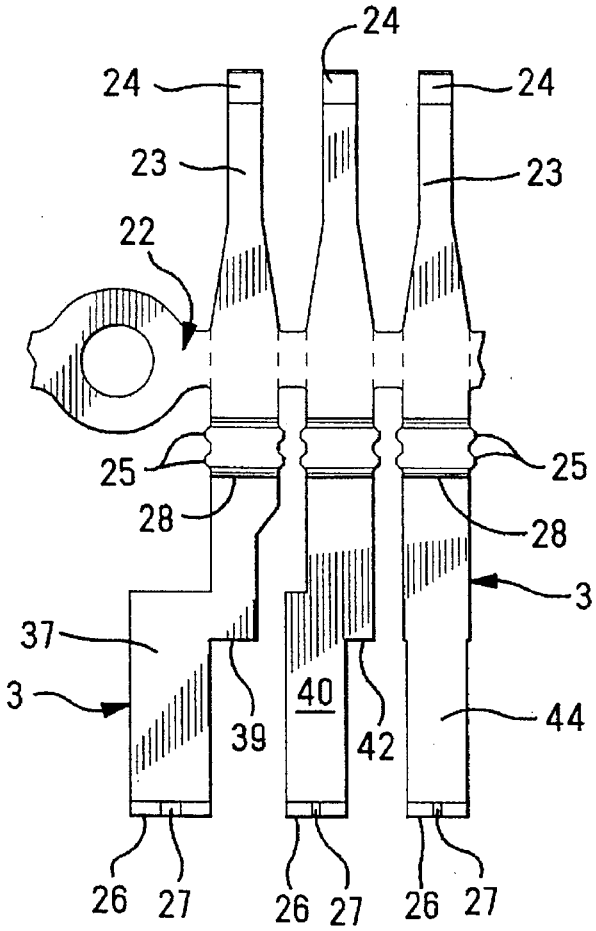
FIG. 8 is a plan view of a second row of electrical contacts in blank form and prior to being formed to shape for use in the electrical connector shown in FIG. 1.
Figure 9:
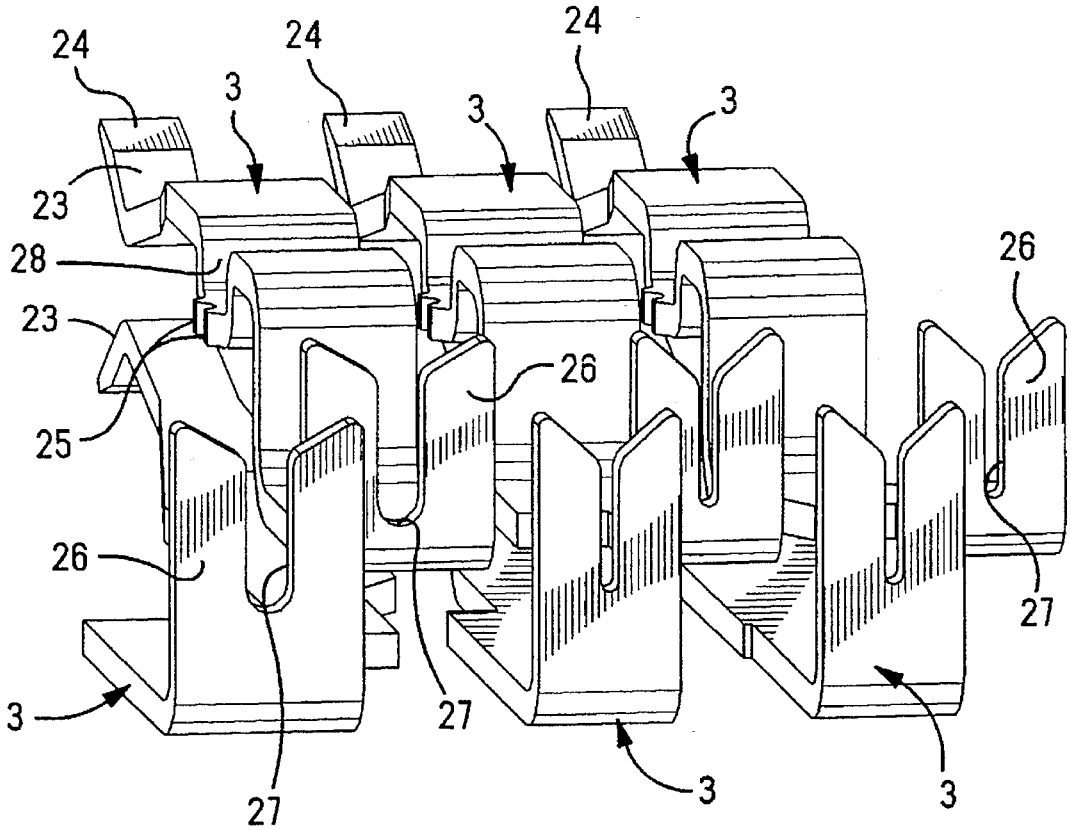
FIG. 9 is an isometric view of the first and second rows of contacts as shown in FIG. 8, with the contacts being formed to shape.

With reference to FIGS. 4, 6, 7, 8 and 9, each of the contacts 3 is of unitary construction, stamped and formed from a blank of metal having a plane of thickness that becomes the plane of thickness of each of the contacts 3. The contacts 3 are manufactured as being connected together by a carrier strip 22, as shown in FIGS. 7 and 8. Subsequently, the individual contacts 3 are separated from one another and from the carrier strip 22. Each contact 3 is manufactured with a forward facing mating contact portion 23, an outwardly flared front tip 24, projecting barbs 25 along opposite lateral sides of the contact 3, and an electrical terminal 26 on a rear end, with a conductor connecting slot 27 along the terminal 26. Each of the terminals 26 is bent at ninety degrees to project toward the open side 10 of the housing 2. The barbs 25 are located along a deeply bowed portion 28 of the contact 3.

With reference to FIGS. 1, 2, 3 and 6, individual contacts 3 are assembled along individual channels 29 in the opposite sides 4, 5 of the insulator 3. The contacts 3 are located along the channels 29 by the deeply bowed portions 28 in registration with deep portions 30 of the channels 29. The barbs 25 impinge and wedge against opposite sides of the channels 29 to retain the contacts 3 along the channels 29. The channels 29 each open into respective slotted openings 31 through the opposite sides 4, 5 and through an interior of the deep mouth 11, as depicted in FIGS. 3 and 6. The mating contact portions 23 on the contacts 3 comprise resilient spring fingers extending through the slotted openings 31 and into the interior of the deep mouth 11 for mating connection with electrical contacts, not shown, of a mating electrical connector, not shown, received in the deep mouth 11. The front tips 24 of the contacts 3 are outwardly flared to prevent stubbing abruptly against the mating electrical connector, not shown.

With reference to FIGS. 1, 2 and 3, the terminals 26 face away from the insulator 6, and toward the open side 10 of the housing 2, such that the slots 27 extend toward the open side 10 of the housing 2. Shorter electrical terminals 26 are on the contacts 3 on the side 4 of the insulator 6. Longer electrical terminals 26 are on the contacts 3 on the second side 5 of the insulator. The longer terminals 26 cross over the insulator 6, FIG. 3, and face in the same direction as the shorter terminals 26. The shorter terminals 26 are in one row of terminals 26. The longer terminals 26 are in another row of terminals 26 rearward of the first row of the terminals 26. The terminals 26 move rearwardly into positions beside projecting, terminal supporting columns 32 that are unitary with a side 33 of the housing 2. The columns 32 are in two rows and are spaced apart to align with the spaced apart terminals 26 in the two rows of terminals 26.

Figure 5:
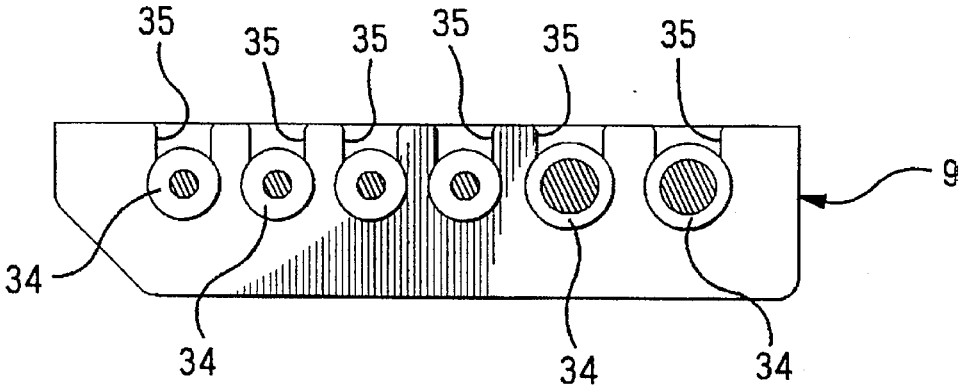
FIG. 5 is a schematic view of multiple electrical conductors of an electrical cable assembled in a cover.

With reference to FIGS. 3 and 5, insulated conductors 34 of an electrical cable are laid side by side and close together along grooved, conductor receiving passages 35 in an interior of the cover 9. The conductors 34 are side by side and close together. The spacing between central axes of the side by side conductors 34 is known as the pitch spacing of the conductors 34. The spacing of and between the passages 36 corresponds with the pitch spacing of the conductors 34. The terminals 26 are spaced apart on pitch spacings that correspond with the pitch spacings of the conductors 34. The cover 9 and the conductors 34 are moved toward the slots 27 that face the open side 10 of the housing 2. The terminals 26 intercept the passages 35. The shorter terminals 26 project across an imaginary plane to intersect alternate conductors 34 extending along said plane. The longer terminals 26 project across said imaginary plane to intersect different alternate conductors 34 extending along said plane. The cover 9 urges the conductors 34 along the slots 27 to terminate the conductors 34 with the connector 1. Projecting wedge shaped latches 36, FIG. 2, along the passages 35 in the cover 9 latch to the housing 2. The cover 9 remains impinged against the conductors 34 while the conductors 34 are fully inserted in the slots 27. The slot 27 in each contact 3 has an open end to receive one of the insulated conductors 34. Opposite sides along the slot 27 slice through insulation on the conductor 34, and grip the conductor 34 to establish an electrical connection. Different widths of the slots 27 accommodate different widths or different diameters of the conductors 34. The terminals 26 that connect to larger conductors 34 have larger sizes for strength. The insulator 6 supports the shorter terminals 26 to resist forces occurring during insertion of the conductors 34. The side 33 of the housing 2 opposite the open side 10 supports the longer terminals 26 to resist forces occurring during insertion of the conductors 34. The columns 32 keep the terminals 26 upright and prevent the terminals 26 from bending over.

Figure 4:
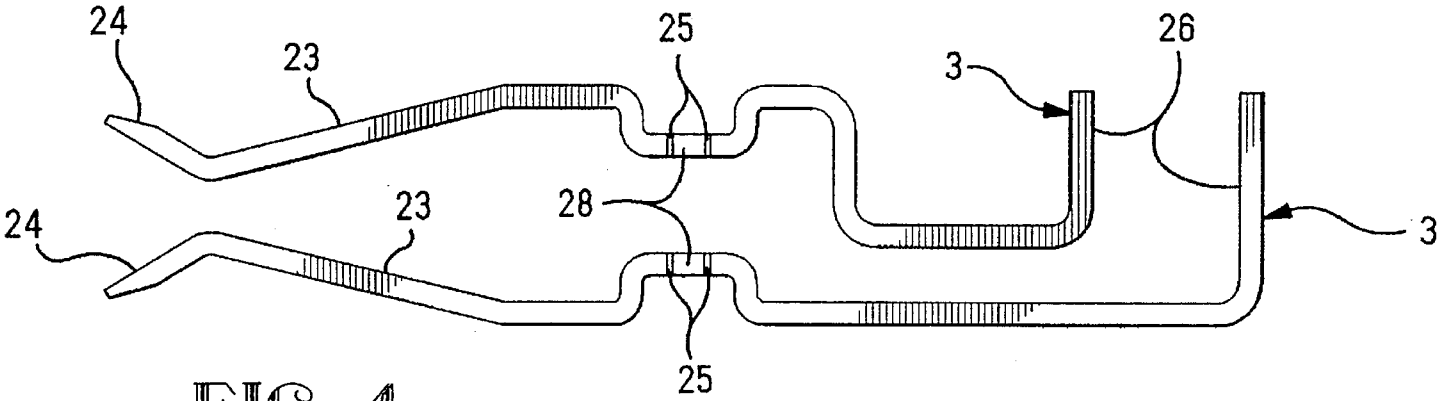
FIG. 4 is an elevation view or side view of a pair of electrical terminals in positions as they would appear in the electrical connector as shown in FIGS. 1–4.

With reference to FIGS. 3, 4 and 6, the contacts 3 are arranged in pairs, with the contact portions 23 on each pair opposing and overlying each other across the insulator 6. The insulator 6 is between the contacts 3 of each pair. One of the pairs is shown in FIGS. 3 and 4. In FIG. 6 one of the pairs is separated from the insulator 6 to show details of construction. The terminals 26 on the pairs of contacts 3 will now be described with reference to FIGS. 7, 8 and 9, taken in conjunction with FIGS. 1 and 2. A first contact 37 and a second contact 38 comprise a first pair of the contacts 3. A first terminal 26 on the first contact 37 is offset laterally by an offset portion 39 a full pitch spacing with respect to a second terminal 26 on the second contact 38. The second terminal 26 on the second contact 38 is aligned on the same pitch opening with the mating contact portion 23 on the second contact 38.

A third contact 40 and a fourth contact 41 comprise a second pair of the contacts 3. Third and fourth terminals 26 on the third contact 40 and the fourth contact 41 are offset laterally by offset portions 42, 43 in opposite directions one-half of a full pitch spacing.

A fifth contact 44 and a sixth contact 45 comprise a third pair of the contacts 3. A fifth terminal 26 on the fifth contact 44 is aligned straight on the same pitch spacing with the mating contact portion 23 on the fifth contact 44. A sixth terminal 26 on the sixth contact 45 is offset laterally by an offset portion 46 a full pitch spacing with respect to the fifth terminal 26 on the fifth contact 44. The first and the sixth terminals 26 are offset laterally in opposite directions. The terminals 26 in different rows of the terminals 26 are offset from each other in a direction from front to rear. The terminals 26 are offset by different amounts in directions laterally of the connector 1.

An advantage of the invention resides in a unit adapted for assembly in an insulating housing, comprising, an insulator and multiple contacts having different shapes, which avoids a need for a housing manufactured with passages of different shapes to receive contacts having different shapes.

We claim:

1. An electrical connector comprising: electrical contacts, forward facing mating contact portions on the contacts, an insulator, the contacts being on opposite sides of the insulator, electrical terminals on the contacts, the terminals on the contacts on a first side of the insulator being shorter, the terminals on the contacts on a second side of the insulator being longer, the longer terminals projecting across the insulator and in a row of terminals rearward of the shorter of terminals, and further wherein; the insulator supports the shorter terminals, and the housing supports the longer terminals.

2. An electrical connector comprising: an insulating housing, electrical contacts arranged in first and second rows of contacts, the rows being on opposite sides of an insulator, the insulator and the contacts being assembled together as a unit and adapted to be assembled in the housing as a unit, electrical first terminals on a first row of the contacts facing away from the insulator and being supported against the insulator, second electrical terminals on a second row of the contacts facing in the same direction as the first terminals, the second terminals being longer than the first terminals, and the second terminals projecting across the insulator and being supported against the housing.

3. An electrical connector as recited in claim 2, comprising: the housing having an opening, the terminals facing toward the opening, conductor terminating slots along the terminals and extending toward the opening, a cover covering the opening, and conductor aligning passages along the cover, the slots along the terminals intercepting the passages, and the conductor aligning passages being adapted to receive respective conductors and to engage against the conductors when the conductors are along the slots and terminated by the terminals.

4. An electrical connector as recited in claim 2, and further comprising: individual channels in opposite sides of the insulator, and the contacts being assembled along said individual channels.

5. An electrical connector as recited in claim 2, and further comprising: terminal supporting columns on a side of the housing facing an open side of the housing, and the columns being beside corresponding terminals.

6. An electrical connector as recited in claim 2 wherein at least one of said first terminals on one of said contacts is laterally offset by a full pitch spacing with respect to a corresponding mating contact portion on the same one of said contacts, and at least one of said second terminals on a second of said contacts is aligned on the same pitch spacing with respect to a corresponding mating contact portion on the same second of said contacts, and said one of said first terminals and said one of said second terminals are laterally offset from each other by a full pitch spacing.

7. An electrical connector comprising: two rows of electrical contacts on opposite sides of an insulator, the contacts being arranged in pairs of contacts, with mating contact portions on the contacts of each pair opposing each other across the insulator, and terminals on the contacts to connect with conductors that are spaced apart on pitch spacings, a housing, the electrical contacts and the insulator being in the housing, shorter electrical terminals being on respective electrical contacts on one side of the insulator, longer electrical terminals being on respective electrical contacts on the other side of the insulator, the longer electrical terminals and the shorter electrical terminals extending in the same direction, the insulator supporting the shorter terminals, and the housing supporting the longer terminals, and wherein;

first and second contacts comprise at least one of said pairs of contacts, a first of said terminals on the first contact is laterally offset by a full pitch spacing with respect to a corresponding mating contact portion on the first contact, and a second of said terminals on the second contact is aligned on the same pitch spacing with respect to a corresponding mating contact portion on the second contact, and the first and the second of said terminals are laterally offset from each other by a full pitch spacing.

8. An electrical connector as recited in claim 7, and further comprising: an open side of the housing, the shorter terminals extending toward the open side, and the longer electrical terminals crossing over the insulator to extend toward the open side.

9. An electrical connector as recited in claim 8, and further comprising: terminal supporting columns on a side of the housing facing the open side, and the columns being beside corresponding terminals.

10. An electrical connector as recited in claim 8, and further comprising: conductor connecting slots in the terminals, the slots extending toward the open side.

11. An electrical connector comprising: a housing, an insulator, electrical contacts on opposite sides of the insulator, the electrical contacts and the insulator being in the housing, mating contact portions on the electrical contacts, shorter electrical terminals on respective electrical contacts on one side of the insulator, longer electrical terminals on respective electrical contacts on the other side of the insulator, the longer electrical terminals and the shorter electrical terminals extending in the same direction, the insulator supporting the shorter terminals, and the housing supporting the longer terminals.

12. An electrical connector as recited in claim 11, and further comprising: an open side of the housing, the shorter terminals extending toward the open side, and the longer electrical terminals crossing over the insulator to extend toward the open side.

13. An electrical connector as recited in claim 12, and further comprising: conductor connecting slots in the terminals, the slots extending toward the open side.

14. An electrical connector as recited in claim 11, and further comprising: terminal supporting columns on a side of the housing facing the open side, and the columns being beside corresponding terminals.

15. An electrical connector as recited in claim 11, wherein third and fourth contacts comprise a second pair of the contacts, and third and fourth of said terminals on the third and fourth contacts are offset laterally in opposite directions one-half of a full pitch spacing.

16. An electrical connector as recited in claim 15, wherein fifth and sixth contacts comprise a third pair of the contacts, a sixth of said terminals on the sixth contact is laterally offset by a full pitch spacing with respect to a corresponding mating contact portion on the sixth contact, a fifth of said terminals on the fifth contact is aligned on the same pitch spacing with respect to a corresponding mating contact portion on the fifth contact, and the fifth and sixth of said terminals are laterally offset from each other by a full pitch spacing.

17. An electrical connector comprising:

first and second rows of contacts arranged in a housing, the housing surrounding an insulator, the first and second rows of contacts extending axially along opposite first and second side surfaces of the insulator, the first row of contacts containing first terminals adjacent said first insulator side for termination, and the second row of contacts containing second terminals, the second terminals being longer than the first terminals and projecting transversely across the insulator to also be adjacent said first insulator side for termination, the first terminals being supported by the insulator and said second terminals being supported by the housing during conductor termination thereto.

* * * * *